US008118203B2

(12) United States Patent
Lee

(10) Patent No.: US 8,118,203 B2
(45) Date of Patent: Feb. 21, 2012

(54) HAMMER-DRIVE POWDER-ACTUATED TOOL

(76) Inventor: Chung-Yi Lee, Taipei (TW)

( * ) Notice: Subject to any disclaimer, the term of this patent is extended or adjusted under 35 U.S.C. 154(b) by 209 days.

(21) Appl. No.: 12/608,608

(22) Filed: Oct. 29, 2009

(65) Prior Publication Data

US 2010/0270351 A1 Oct. 28, 2010

(30) Foreign Application Priority Data

Apr. 28, 2009 (TW) ..... 98207118 U

(51) Int. Cl.
*B25C 1/18* (2006.01)

(52) U.S. Cl. ..... 227/10; 227/9; 227/11; 227/147; 102/471

(58) Field of Classification Search ..... 227/147, 227/9–11; 42/69.01, 69.02, 69.03; 89/27.13, 89/27.14; 102/471
See application file for complete search history.

(56) References Cited

U.S. PATENT DOCUMENTS 966,163 A * 8/1910 Buell ..... 102/471
4,025,029 A * 5/1977 Kotas et al. ..... 227/10
4,830,252 A * 5/1989 Gottlieb et al. ..... 227/8
4,867,365 A * 9/1989 Buechel et al. ..... 227/10
5,216,199 A * 6/1993 Bjerke et al. ..... 102/471
5,310,108 A * 5/1994 Popovich et al. ..... 227/10
6,352,033 B1 * 3/2002 Brede et al. ..... 102/430

* cited by examiner

*Primary Examiner* — Rinaldi I. Rada
*Assistant Examiner* — Michelle Lopez
(74) *Attorney, Agent, or Firm* — Pepper Hamilton LLP

(57) ABSTRACT

A hammer-drive powder-actuated tool includes a hollow tool body extending along a front-to-rear direction, and a firing device disposed within a rear end portion of the tool body. The firing device includes a pin holder having a through hole extending along the front-to-rear direction, and a firing pin movable forwardly and rearwardly relative to the pin holder. The pin has a firing end portion that is disposed at a front end thereof and that extends into the through hole in the pin holder, and a central axis aligned with that of a rimfire cartridge along the front-to-rear direction. A front end of the firing end portion of the firing pin has a diameter larger than the inner diameter of the annular primer and smaller than the outer diameter of the annular primer.

11 Claims, 6 Drawing Sheets

HAMMER-DRIVE POWDER-ACTUATED TOOL

CROSS-REFERENCE TO RELATED APPLICATION

This application claims priority of Taiwanese Application No. 098207118, filed on Apr. 28, 2009.

BACKGROUND OF THE INVENTION

1. Field of the Invention

This invention relates to a hammer-drive powder-actuated tool, and more particularly to a hammer-drive powder-actuated tool that has a high success rate in ignition of a primer and that is safe to use.

2. Description of the Related Art

Referring to FIG. 1, a conventional hammer-drive powder-actuated tool 1 includes a tubular tool body 11, an inner tube 12 movable forwardly and rearwardly within the tool body 11, a sleeve 13 connected to a rear end of the inner tube 12 and formed with an accommodating chamber 131 for receiving a powder cartridge (not shown), a piston 14 movable forwardly and rearwardly within the inner tube 12, and a firing device 15.

The firing device 15 includes a pin holder 151 disposed within the tool body 11 and abutting against a rear end of the sleeve 13, a firing pin 152 extending into the pin holder 151, a coiled compression spring 153 sleeved on the firing pin 152 and abutting against the pin holder 151, a nut 154 engaging an externally threaded rear end of the firing pin 152 and abutting against a rear end 157 of the coiled compression spring 153, and a positioning pin 158 extending through the nut 154 and the externally threaded rear end of the firing pin 152 to fix the nut 154 relative to the firing pin 152. The pin holder 151 has a front end formed with a cavity 156. The firing pin 152 has a head 155 disposed within the cavity 156.

During use, a hammer (not shown) is operated to strike the externally threaded rear end of the firing pin 152 to move the head 155 of the firing pin 152 into contact with the powder cartridge so as to ignite the powder cartridge to thereby drive forward movement of the piston 14.

The abovementioned conventional hammer-drive powder-actuated tool l 1 suffers from the following disadvantages:

(1) The head 155 of the firing pin 152 has a diameter much larger than that of the rear end of the powder cartridge. As such, when the powder cartridge is stricken by the firing pin 152, if the central axis of the firing pin 152 is inclined relative to that of the powder cartridge, misfire may occur.

(2) To prevent accidental removal of the powder cartridge from the chamber 131 when the tool 1 is in an upright state such that the cartridge is disposed above the firing pin 152, a reed spring 159 is disposed on a front end of the pin holder 151 and between the head 155 of the firing pin 152 and the powder cartridge. In case of accidental dropping of the tool 1, however, the powder cartridge may hit the reed spring 159 by virtue of the gravity of the inner tube 12 and the sleeve 13 to result in ignition of a primer of the powder cartridge, thereby affecting safety during use.

SUMMARY OF THE INVENTION

An object of this invention is to provide a hammer-drive powder-actuated tool that has a high success rate in ignition of a primer.

Another object of this invention is to provide a hammer-drive powder-actuated tool that is safe to use.

According to this invention, a hammer-drive powder-actuated tool is adapted for activating ignition of a rimfire cartridge. The rimfire cartridge has a rear end and an annular primer disposed at the rear end of the rimfire cartridge. The tool includes a hollow tool body extending along a front-to-rear direction; and a firing device disposed within a rear end portion of the tool body. The firing device includes a pin holder and a firing pin. The pin holder has a through hole extending along the front-to-rear direction. The firing pin is movable forwardly and rearwardly relative to the pin holder, and has a firing end portion that is disposed at a front end thereof and that extends into the through hole in the pin holder, and a central axis adapted to be aligned with that of the rimfire cartridge along the front-to-rear direction, a front end of the firing end portion of the firing pin having a diameter adapted to be larger than an inner diameter of the annular primer and smaller than an outer diameter of the annular primer.

Preferably, the through hole in the pin holder has a front hole section. The front hole section has a front distal end, a rear distal end, and a diameter that reduces gradually from the front distal end to the rear distal end so that the front section has a minimum diameter at the rear distal end. The minimum diameter of the front hole section is adapted to be smaller than that of the rear end of the rimfire cartridge.

Preferably, the front section of the through hole in the pin holder further has a maximum diameter at the front distal end, which is adapted to be slightly larger than that of the rear end of the rimfire cartridge.

Preferably, the firing end portion of the firing pin has a large-diameter section and a small-diameter section disposed in front of the large-diameter section, having a diameter smaller than that of the large-diameter section, and adapted to be movable into contact with the annular primer of the rimfire cartridge.

Preferably, the through hole in the pin holder further has a small-diameter hole section disposed behind and connected to the front hole section and having a diameter the same as that of the rear distal end of the front hole section and smaller than the diameter of the large-diameter section of the firing end portion of the firing pin, and a large-diameter hole section disposed behind and connected to the small-diameter hole section and having a diameter larger than that of the small-diameter hole section. The large-diameter section of the firing end portion of the firing pin is disposed within the large-diameter hole section of the through hole in the pin holder. The small-diameter section of the firing end portion of the firing pin is disposed within the large-diameter and small-diameter hole sections of the through hole in the pin holder.

Preferably, the firing pin further has a rod portion disposed behind and formed integrally with the firing end portion and extending along the front-to-rear direction, a head disposed behind and formed integrally with the rod portion and adapted to permit application of an external force thereto, and a shoulder defined between the firing end portion and the rod portion. The firing device further includes a retaining member sleeved on the rod portion of the firing pin, and a resilient member disposed between the retaining member and the head of the firing pin for biasing the retaining member to abut against the shoulder of the firing pin and a rear end of the pin holder, thereby allowing the firing end portion of the firing pin to be spaced apart from the rear end of the rimfire cartridge by a predetermined distance when no external force is applied to the firing pin.

Preferably, the tool body has an annular inner wall surface, and the retaining member is generally U-shaped, and has an outer periphery in contact with the annular inner wall surface of the tool body.

Preferably, the retaining member is configured as a generally U-shaped plate.

Preferably, the resilient member is configured as a coiled compression spring.

Preferably, the firing device further includes a rigid washer sleeved on the rod portion of the firing pin between the retaining member and the resilient member.

Preferably, the tool body includes a tubular portion having a rear end portion, and a grip portion having a front end portion sleeved fixedly on the rear end portion of the tubular portion. The tubular portion has a first stop flange extending radially and inwardly from an intermediate portion of the tubular portion, and a second stop flange extending radially and inwardly from a rear end of the tubular portion. The pin holder has a small-diameter holder portion and a large-diameter holder portion disposed behind and connected to the small-diameter holder portion and having an outer diameter larger than that of the small-diameter holder portion. The large-diameter holder portion has a front end surface abutting against the first stop flange of the tool body, and a rear end surface abutting against the retaining member. The washer has a front side surface abutting against the retaining member, and a rear side surface abutting against the second stop flange of the tool body. As such, the pin holder, the retaining member, and the washer are fixed within the tool body.

Since the diameter of the front end of the firing end portion of the firing pin is larger than the inner diameter of the annular primer and smaller than the outer diameter of the annular primer, the firing end portion of the firing pin can strike the primer of the rimfire cartridge even when the central axis of the firing pin is somewhat misaligned or inclined from that of the rimfire cartridge during striking of the firing pin against the rimfire cartridge. As a result, the success rate in ignition of the primer of the rimfire cartridge can be increased significantly.

Furthermore, since the minimum diameter of the front hole section is adapted to be smaller than that of the rear end of the rimfire cartridge, accidental dropping of the rimfire cartridge and accidental firing of the tool can be prevented. Thus, the tool is safe to use.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
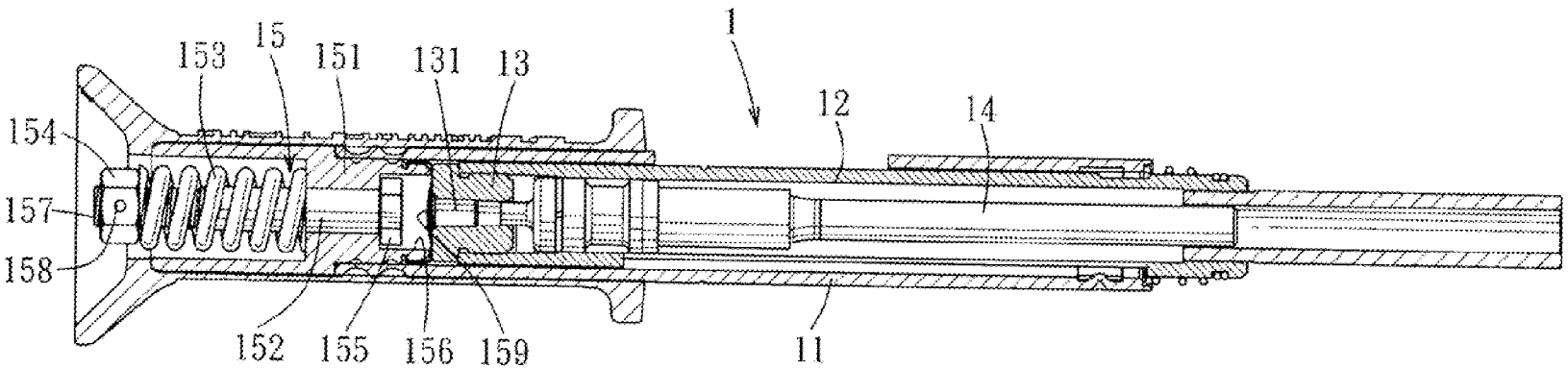
FIG. 1 PRIOR ART
FIG. 1 is a sectional view of a conventional hammer-drive powder-actuated tool.

Before the present invention is described in greater detail in connection with the preferred embodiments, it should be noted that similar elements and structures are designated by like reference numerals throughout the entire disclosure.

Figure 2:
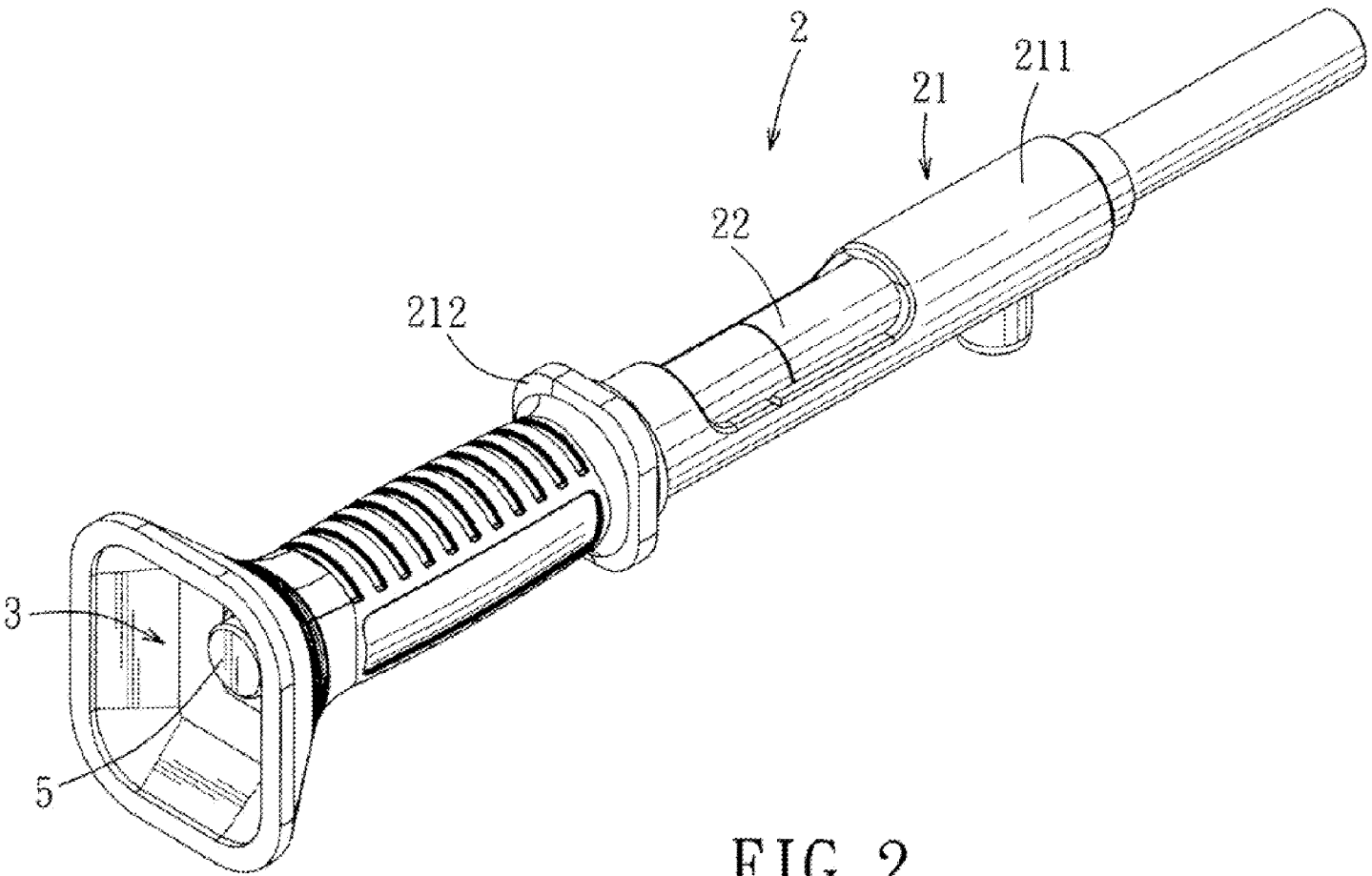
FIG. 2 is an assembled perspective view of the first preferred embodiment of a hammer-drive powder-actuated tool according to this invention.
Figure 3:
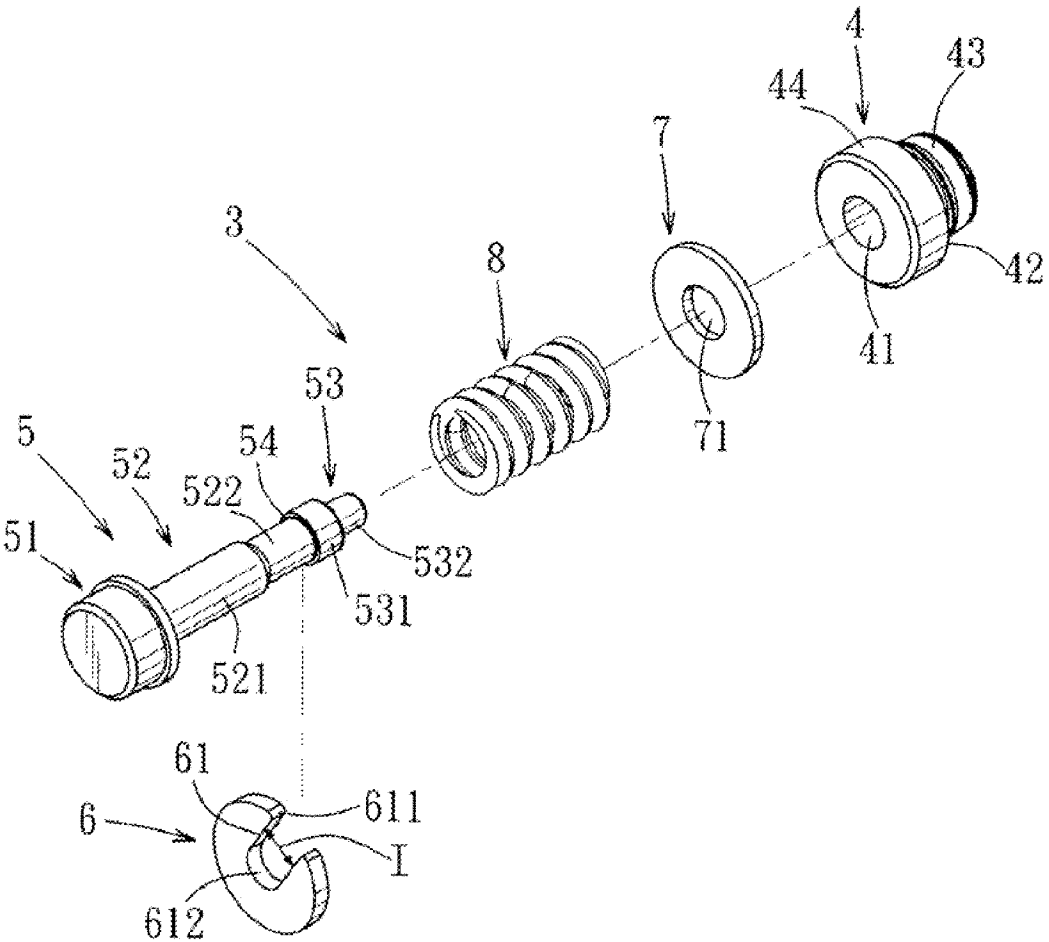
FIG. 3 is a fragmentary exploded perspective view of the first preferred embodiment, illustrating a firing device.
Figure 4:
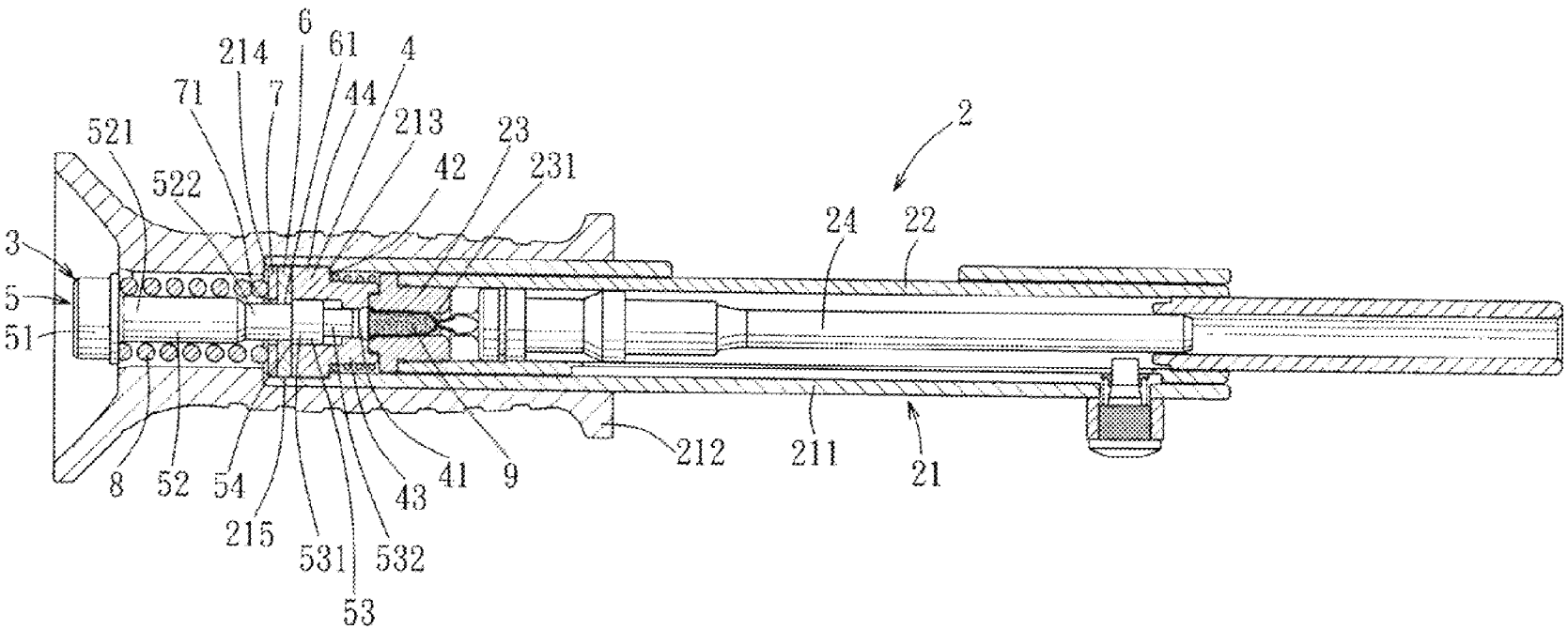
FIG. 4 is a sectional view of the first preferred embodiment.

Referring to FIGS. 2, 3, and 4, the first preferred embodiment of a hammer-drive powder-actuated tool 2 according to this invention is used for activating ignition of a rimfire cartridge 9. The tool 2 includes a hollow tool body 21 extending along a front-to-rear direction, an inner tube 22 movable forwardly and rearwardly within the tool body 21, a sleeve 23 disposed within and engaging threadably a rear end portion of the inner tube 21 and having a rear end formed with an accommodating chamber 231 for receiving the rimfire cartridge 9, a piston 24 movable forwardly and rearwardly within the inner tube 22 and driven by the rimfire cartridge 9 when the rimfire cartridge 9 is ignited, and a firing device 3 disposed within a rear end portion of the tool body 21 for igniting the rimfire cartridge 9 within the chamber 231 in the sleeve 23.

Figure 5:
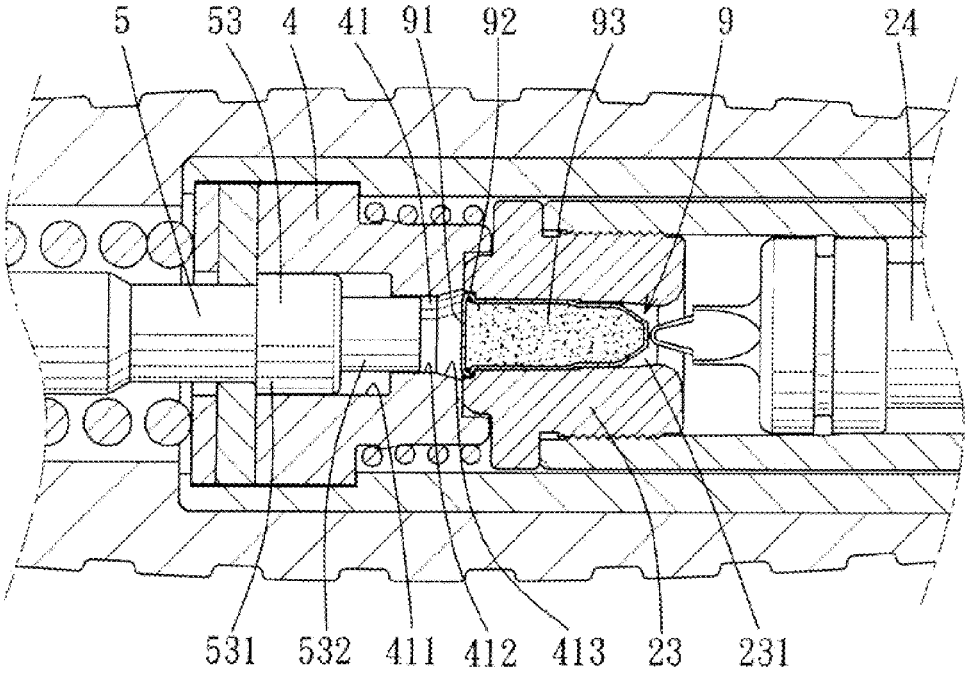
FIG. 5 is a fragmentary sectional view of the first preferred embodiment, illustrating a firing pin in a non-striking position.
Figure 6:
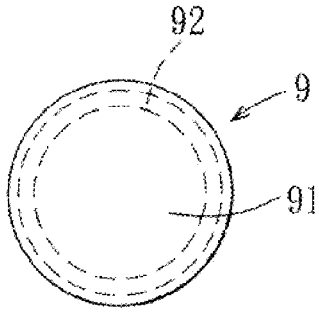
FIG. 6 is a rear view of a rimfire cartridge of the first preferred embodiment.

With further reference to FIGS. 5 and 6, the rimfire cartridge 9 has a rear end 91 and an annular primer 92 disposed at the rear end 91.

The tool body 21 has a tubular portion 211, and a grip portion 212 having a front end portion sleeved fixedly on a rear end portion of the tubular portion 211. The tubular portion 211 has a first stop flange 213 extending radially and inwardly from an intermediate portion of the tubular portion 211, and a second stop flange 214 extending radially and inwardly from a rear end of the tubular portion 211. In this embodiment, the second stop flange 214 is formed by a rolling process.

The firing device 3 includes a pin holder 4, a firing pin 5, a retaining member 6, a rigid washer 7, and a resilient member 8.

The pin holder 4 is disposed behind the sleeve 23, and has a small-diameter holder portion 43, a large-diameter holder portion 44 disposed behind and connected to the small-diameter holder portion 43 to define a shoulder 42 therebetween, and a through hole 41 formed through the large-diameter and small-diameter holder portions 44, 43 and extending along the front-to-rear direction. The large-diameter holder portion 44 has a front end surface abutting against the first stop flange 213 of the tool body 21. The through hole 41 has a front hole section 413, a small-diameter hole section 412, and a large-diameter hole section 411. The front hole section 413 has a diameter that reduces gradually from a front distal end thereof to a rear distal end thereof. As such, the front hole section 413 has a maximum diameter at the front distal end thereof, and a minimum diameter at the rear distal end thereof. The maximum diameter of the front hole section 413 is slightly larger than the diameter of the rear end 91 of the rimfire cartridge 9. The minimum diameter of the front hole section 413 is smaller than that diameter of the rear end 91 of the rimfire cartridge 9.

The small-diameter hole section 412 is disposed behind and connected to the front hole section 413, and has a diameter the same as that of the rear distal end of the front hole section 413. The large-diameter hole section 411 is disposed behind and connected to the small-diameter hole section 412, and has a diameter larger than that of the small-diameter hole section 412. The through hole 41 can be formed easily by a lathe, thereby reducing the manufacturing costs of the pin holder 4.

The firing pin 5 is movable forwardly and rearwardly relative to the pin holder 5, and has a firing end portion 53 that is disposed at a front end thereof, that extends into the through hole 41 in the pin holder 4, and that is movable forwardly into contact with the annular primer 92 of the rimfire cartridge 9. The firing pin 5 further has a rod portion 52 disposed behind and connected to the firing end portion 53 and extending along the front-to-rear direction, a head 51 disposed behind and connected to the rod portion 52 and permitting application of an external force thereto by a hammer (not shown), and a shoulder 54 defined between the firing end portion 53 and the rod portion 52. In this embodiment, the firing end portion 53, the rod portion 52, and the head 51 are integrally formed with each other. The head 51 has a diameter larger than those of the rod portion 52 and the firing end portion 53.

The central axis of the firing pin 5 is aligned with that of the rimfire cartridge 9 along the front-to-rear direction. A front end of the firing end portion 53 has a diameter that is larger than the inner diameter of the annular primer 92 of the rimfire cartridge 9 and smaller than the outer diameter of the annular primer 92 of the rimfire cartridge 9. The firing end portion 53 of the firing pin 5 has a large-diameter section 531 and a small-diameter section 532 disposed in front of the large-diameter section 531, having a diameter smaller than that of the large-diameter section 531, and movable in contact with the annular primer 92 of the rimfire cartridge 9.

The firing end portion 53 of the firing pin 5 has an axial length smaller than that of the through hole 41 in the pin holder 4. The large-diameter section 531 of the firing end portion 53 of the firing pin 5 has an axial length smaller than that of the large-diameter hole section 411 of the through hole 41 in the pin holder 4 so as to permit the large-diameter section 531 of the firing end portion 53 to be received within the large-diameter hole section 411. The large-diameter section 531 of the firing end portion 53 of the firing pin 5 has a diameter larger than that of the small-diameter hole section 412 of the through hole 41 in the pin holder 4 so as to prevent movement of the large-diameter section 531 into the small-diameter hole section 412. A portion of the small-diameter section 532 of the firing pin 5 is disposed within the large-diameter hole section 411 of the through hole 41 in the pin holder 4. The remaining portion of the small-diameter section 532 of the firing pin 5 is disposed within the small-diameter hole section 412 of the through hole 41. As such, the travel distance of the firing pin 5 is limited.

The rod portion 52 of the firing pin 5 has a first section 521 having a rear end connected to the head 51, and a second section 522 connected between the first section 521 and the firing end portion 53 and having a diameter smaller than that of the first section 521. In this embodiment, the second section 522 has a diameter smaller than that of the large-diameter section 531 of the firing end portion 53 to form the shoulder 54 between the second section 522 and the large-diameter section 531. The first section 521 and the large-diameter section 531 have the same diameter such that an annular groove is formed therebetween. The annular groove can be formed easily by lathing.

The retaining member 6 is sleeved on the rod portion 52 of the firing pin 5, and has a front side surface abutting against the large-diameter holder portion 44 of the pin holder 4 and the shoulder 54 of the firing pin 5. In this embodiment, the retaining member 6 is configured as a generally U-shaped plate, and a radially extending slot 61 having an open end 611, a closed end 612, and a width (I) approximate to the diameter of the second section 522 of the rod portion 52 of the firing pin 5 so as to prevent removal of the retaining member 6 from the firing pin 5 along the front-to-rear direction.

The washer 7 is sleeved on the rod portion 52 of the firing pin 5 between the retaining member 6 and the resilient member 8. The washer 7 has a front side surface abutting against the retaining member 6, and a rear side surface abutting against the second stop flange 214 of the tool body 21. Since the large-diameter holder portion 44 of the pin holder 4 is disposed between and abuts against the first stop flange 213 of the tool body 21 and the retaining member 6, and since the washer 7 is disposed between and abuts against the second stop flange 214 of the tool body 21 and the retaining member 6, the pin holder 4, the retaining member 6, and the washer 7 are fixed within the tool body 21. The washer 7 has an inner diameter larger than the diameter of the large-diameter section 531 of the firing end portion 53 of the firing pin 5, and hence can be sleeved onto the rod portion 52 of the firing pin 5 via the front end of the firing pin 5.

The resilient member 8 is configured as a coiled compression spring, is sleeved on the rod portion 52 of the firing pin 5, and has a front end abutting against the retaining member 6, and a rear end abutting against the head 51 of the firing pin 5. As such, the firing pin 5 is biased by the resilient member 8 to move rearwardly away from the rimfire cartridge 9 to thereby allow the firing end portion 53 of the firing pin 5 to be spaced apart from the rear end 91 of the rimfire cartridge 9 by a predetermined distance when no external force is applied to the firing pin 5.

During assembly, the resilient member 8 is first sleeved onto the rod portion 52 of the firing pin 5 via the front end of the firing pin 5 to allow the rear end of the resilient member 8 to abut against the head 51 of the firing pin 5. Next, the washer 7 is sleeved onto the rod portion 52 via the front end of the firing pin 5, and is moved rearwardly to and maintained in a position located behind the shoulder 54 of the firing pin 5 by a positioning means (not shown). The retaining member 6 is sleeved onto the second section 522 of the rod portion 52 between the washer 7 and the shoulder 54. Subsequently, the positioning means is removed. Hence, the retaining member 6 and the washer 7 are pushed forwardly by the resilient member 8 until the retaining member 6 abuts against the shoulder 54.

Subsequent to the assembly of the firing pin 5, the retaining member 6, the washer 7, and the resilient member 8, the pin holder 4 is inserted forwardly into a rear end of the tubular portion 211 of the tool body 21 (since the second stop flange 214 has not been formed at this time, the pin holder 4 can be inserted into the tubular portion 211) until the shoulder 42 (i.e., the front end surface of the large-diameter holder portion 44 of the pin holder 4) abuts against the first stop flange 213. Afterwards, the assembly of the firing pin 5, the retaining member 6, the washer 7, and the resilient member 8 are also inserted forwardly into the rear end of the tubular portion 211 such that the firing end portion 53 of the firing pin 5 is extended into the through hole 41 in the pin holder 4 until the retaining member 6 abuts against the large-diameter holder portion 44 of the pin holder 4. At this time, the rear end of the tubular portion 211 is rolled with the assistance of a jig (not shown) to form the second stop flange 214 such that the second stop flange 214 abuts against the washer 7. As such, any two adjacent ones of the first stop flange 213, the large-diameter holder portion 44 of the pin holder 4, the retaining member 6, and the washer 7 abut against each other, so that the pin holder 4, the retaining member 6, and the washer 7 are fixed within the tool body 21. Thus, the firing device 3 can be assembled quickly and conveniently to the tool portion 211 of the tool body 21.

It should be noted that, the washer 7 is disposed between the coiled compression spring 8 and the retaining member 6 to result in convenience when the jig is placed into the tubular portion 211 of the tool body 21 to compress the coiled compression spring 8. The washer 7 may be omitted from the firing device 3 to allow the coiled compression spring 8 to press directly against the retaining member 6.

Figure 7:
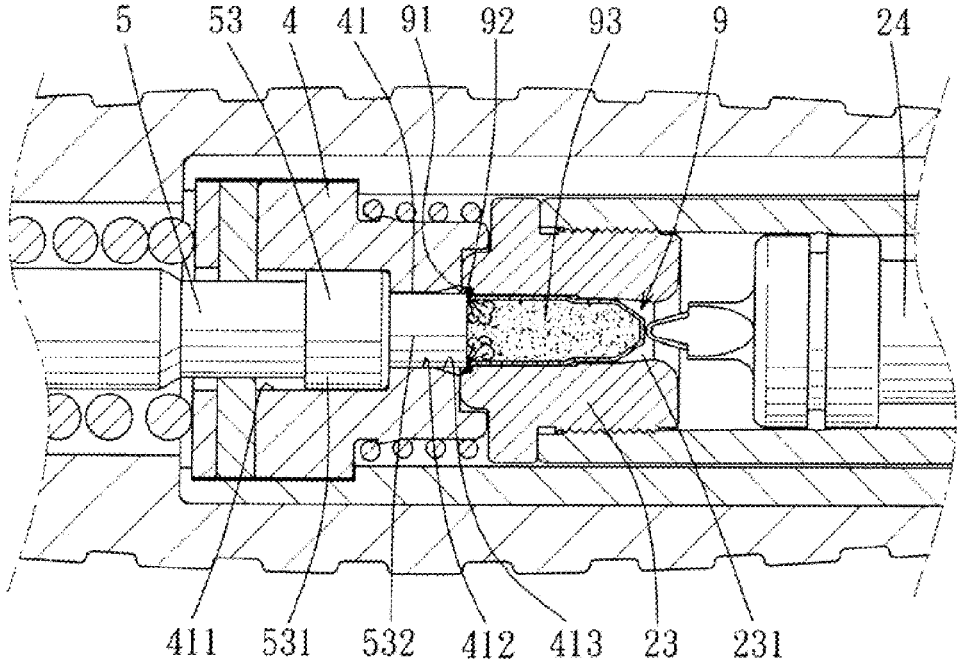
FIG. 7 is a fragmentary sectional view of the first preferred embodiment, illustrating the firing pin in a striking position.

The firing pin 5 is movable within the tool body 21 between a non-striking position shown in FIGS. 4 and 5 and a striking position shown in FIG. 7. When the firing pin 5 is disposed in the non-striking position, the firing end portion 53 of the firing pin 5 is spaced apart from the rimfire cartridge 9 by the predetermined distance, as described above.

In this position, since the rear end 91 of the rimfire cartridge 9 is larger than the minimum diameter of the front section 413 of the through hole 41 in the pin holder 4 and slightly smaller than the maximum diameter of the front section 413, as described above, a wall of the pin holder 5 defining the front section 413 of the through hole 41 can prevent removal of the rimfire cartridge 9 from the chamber 231 when the tool 2 is upright. Furthermore, in case of accidental downward dropping of the tool 2, the primer 92 of the rimfire cartridge 9 cannot hit the firing pin 5. As a consequence, accidental firing of the tool 2 can be substantially eliminated, thereby promoting safety during use of the tool 2. Alternatively, the diameter of the rear end 91 of the rimfire cartridge 9 may be equal to the maximum diameter of the front section 413.

During use, when the head 51 of the firing pin 5 is hammered to move the firing pin 5 from the non-striking position to the striking position, the primer 92 of the rimfire cartridge 9 is ignited to drive forward movement of the piston 24.

It also should be noted that, since the diameter of the small-diameter section 532 of the firing end portion 53 of the firing pin 5 is larger than the inner diameter of the primer 92 and smaller than the outer diameter of the primer 92, as described above, effective striking of the firing pin 5 against the primer 92 of the rimfire cartridge 9 can be ensured even when the central axis of the firing pin 5 is somewhat inclined relative to that of the rimfire cartridge 9 during striking of the firing pin 5 against the rimfire cartridge 9. That is, the success rate in ignition of the primer 92 can be increased significantly.

Figure 8:
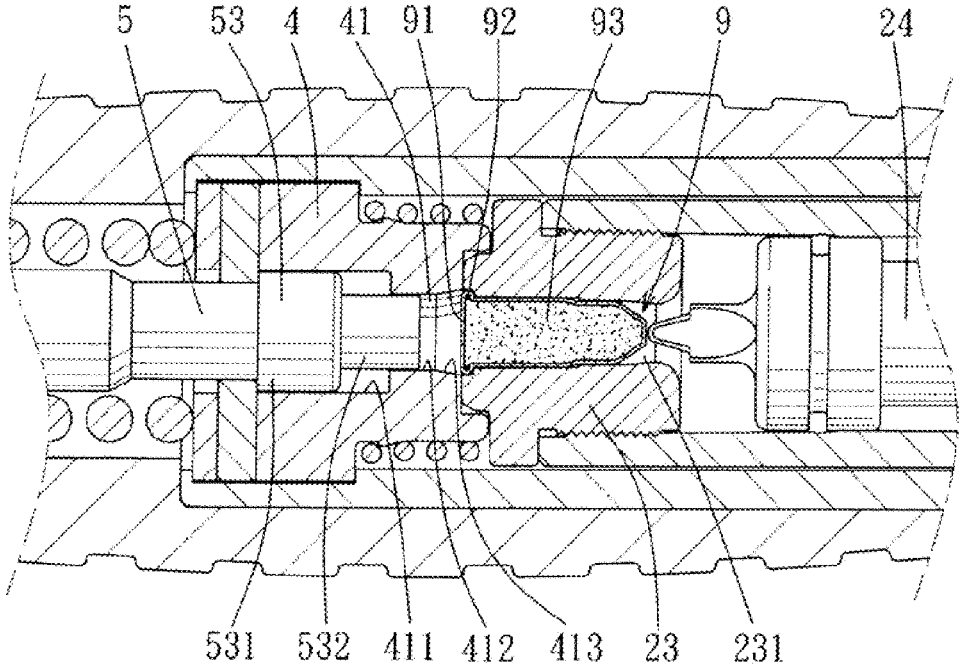
FIG. 8 is a fragmentary sectional view of the second preferred embodiment of a hammer-drive powder-actuated tool according to this invention.

FIG. 8 shows the second preferred embodiment of a hammer-drive powder-actuated tool according to this invention, which is similar in construction to the first preferred embodiment. Unlike the first preferred embodiment, the maximum diameter of the front hole section 413 of the through hole 41 in the pin holder 4 is equal to the diameter of the rear end 91 of the rimfire cartridge 9.

With this invention thus explained, it is apparent that numerous modifications and variations can be made without departing from the scope and spirit of this invention. It is therefore intended that this invention be limited only as indicated by the appended claims.

I claim:

1. A hammer-drive powder-actuated tool adapted for activating ignition of a rimfire cartridge, the rimfire cartridge having a rear end and an annular primer disposed at the rear end of the rimfire cartridge, said tool comprising:

a hollow tool body extending along a front-to-rear direction; and a firing device disposed within a rear end portion of said tool body and including:

a pin holder having a through hole extending along the front-to-rear direction, a firing pin movable forwardly and rearwardly relative to said pin holder and having a firing end portion that is disposed at a front end thereof and that extends into said through hold in said pin holder, and a central axis adapted to be aligned with that of said rimfire cartridge along the front-to-rear direction, a front end of said firing end portion of said firing pin having a diameter adapted to be larger than an inner diameter of the annular primer and smaller than an outer diameter of the annular primer, and wherein said through hole in said pin holder has a front hole section, said front hole section having a front distal end, a rear distal end, and a diameter that reduces gradually from said front distal end to said rear distal end so that said front hole section has a minimum diameter at said rear distal end, the minimum diameter of said front hole section being adapted to be smaller than the minimum diameter of the rear end of the rimfire cartridge.

2. The hammer-drive powder-actuated tool as claimed in claim 1, wherein said front hole section of said through hole in said pin holder further has a maximum diameter at said front distal end, which is adapted to be slightly larger than that of the rear end of the rimfire cartridge.

3. The hammer-drive powder-actuated tool as claimed in claim 2, wherein said firing end portion of said firing pin has a large-diameter section and a small-diameter section disposed in front of said large-diameter section, having a diameter smaller than that of said large-diameter section, and adapted to be movable into contact with the annular primer of the rimfire cartridge.

4. The hammer-drive powder-actuated tool as claimed in claim 3, wherein said through hole in said pin holder further has a small-diameter hole section disposed behind and connected to said front hole section and having a diameter the same as that of said rear distal end of said front hole section and smaller than the diameter of said large-diameter section of said firing end portion of said firing pin, and a large-diameter hole section disposed behind and connected to said small-diameter hole section and having a diameter larger than that of said small-diameter hole section, said large-diameter section of said firing pin being disposed within said large-diameter hole section of said through hole in said pin holder, said small-diameter section of said firing end portion of said firing pin being disposed within said large-diameter and small-diameter hole sections of said through hole in said pin holder.

5. The hammer-drive powder-actuated tool as claimed in claim 4, wherein:

said firing pin further has a rod portion disposed behind and formed integrally with said firing end portion and extending along the front-to-rear direction, a head disposed behind and formed integrally with said rod portion and adapted to permit application of an external force thereto, and a shoulder defined between said firing end portion and said rod portion; and said firing device further includes:

a retaining member sleeved on said rod portion of said firing pin, and a resilient member disposed between said retaining member and said head of said firing pin and adapted for biasing said firing pin to move rearwardly away from the rimfire cartridge to allow said firing end portion of said firing pin to be spaced apart from the rear end of the rimfire cartridge by a predetermined distance when no external force is applied to said firing pin.

6. The hammer-drive powder-actuated tool as claimed in claim 5, wherein said resilient member is configured as a coiled compression spring.

7. The hammer-drive powder-actuated tool as claimed in claim 5, wherein said firing device further includes a rigid washer sleeved on said rod portion of said firing pin between said retaining member and said resilient member.

8. The hammer-drive powder-actuated tool as claimed in claim 7, wherein:

said tool body includes a tubular portion having a rear end portion, and a grip portion having a front end portion sleeved fixedly on said rear end portion of said tubular portion, said tubular portion having a first stop flange extending radially and inwardly from an intermediate portion of said tubular portion, and a second stop flange extending radially and inwardly from a rear end of said tubular portion;

said pin holder has a small-diameter holder portion and a large-diameter holder portion disposed behind and connected to said small-diameter holder portion and having an outer diameter larger than that of said small-diameter holder portion, said large-diameter holder portion having a front end surface abutting against said first stop flange of said tool body, and a rear end surface abutting against said retaining member; and said washer has a front side surface abutting against said retaining member, and a rear side surface abutting against said second stop flange of said tool body;

whereby, said pin holder, said washer, and said retaining member are fixed within said tool body.

9. The hammer-drive powder-actuated tool as claimed in claim 5, wherein said tool body has an annular inner wall surface, and said retaining member is generally U-shaped.

10. The hammer-drive powder-actuated tool as claimed in claim 9, wherein said retaining member is configured as a generally U-shaped plate.

11. The hammer-drive powder-actuated tool as claimed in claim 1, wherein said front hole section of said through hole in said pin holder further has a maximum diameter at said front distal end, which is adapted to be equal to that of the rear end of the rimfire cartridge.

* * * * *